US009428946B2

(12) United States Patent
Martinez Garcia et al.

(10) Patent No.: US 9,428,946 B2
(45) Date of Patent: Aug. 30, 2016

(54) HINGE FOR FURNITURE

(71) Applicant: FAMAR MUEBLES, S.L., Albacete (ES)

(72) Inventors: Francisco Martinez Garcia, Albacete (ES); Fabian Martinez Garcia, Albacete (ES)

(73) Assignee: FAMAR MUEBLES, S.L., Albacete (ES)

( * ) Notice: Subject to any disclaimer, the term of this patent is extended or adjusted under 35 U.S.C. 154(b) by 0 days.

(21) Appl. No.: 14/428,885

(22) PCT Filed: Sep. 10, 2013

(86) PCT No.: PCT/ES2013/070625

§ 371 (c)(1),
(2) Date: Mar. 17, 2015

(87) PCT Pub. No.: WO2014/044887

PCT Pub. Date: Mar. 27, 2014

(65) Prior Publication Data

US 2015/0233161 A1 Aug. 20, 2015

(30) Foreign Application Priority Data

Sep. 19, 2012 (ES) ..... 201230970 U

(51) Int. Cl.

| | |
|---|---|
| ***E05D 3/12*** | (2006.01) |
| ***E05D 11/00*** | (2006.01) |
| ***E05F 1/12*** | (2006.01) |

(52) U.S. Cl.

CPC ..... *E05D 3/122* (2013.01); *E05D 11/0054* (2013.01); *E05F 1/12* (2013.01); *E05D 2011/0072* (2013.01); *Y10T 16/533* (2015.01); *Y10T 16/541* (2015.01)

(58) Field of Classification Search

CPC . Y10T 16/533; Y10T 16/541; Y10T 16/547; Y10T 16/554; E05D 3/122; E05D 5/0276; E05D 5/046; E05D 11/0054; E05D 2011/0072; E05Y 2900/20; E05F 1/12

USPC ..... 16/250, 354, 366, 382; 49/398

See application file for complete search history.

(56) References Cited

U.S. PATENT DOCUMENTS

| | | | | | |
|---|---|---|---|---|---|
| 3,402,422 | A | * | 9/1968 | Baer | 16/366 |
| 4,679,277 | A | | 7/1987 | Shibata | |
| 4,976,008 | A | * | 12/1990 | Baer | 16/354 |
| 4,996,739 | A | * | 3/1991 | Baer | 16/354 |
| 4,999,878 | A | * | 3/1991 | Baer | 16/354 |
| 4,999,879 | A | * | 3/1991 | Baer | 16/354 |

(Continued)

FOREIGN PATENT DOCUMENTS

| | | | |
|---|---|---|---|
| GB | 2451276 | A | 1/2009 |
| WO | 2008025595 | A1 | 3/2008 |
| WO | 2008040832 | A1 | 4/2008 |

OTHER PUBLICATIONS

International Search Report dated Dec. 18, 2013.

*Primary Examiner* — William Miller
(74) *Attorney, Agent, or Firm* — Lucas & Mercanti, LLP

(57) ABSTRACT

Hinge for furniture, comprising at least one pair of leaves (6-7) mounted in a transverse housing in a supporting profile (1) by means of parallel independent rotation pins (14), which extend through the knuckles (9) of the leaves, said knuckles being equipped with teeth (18), parallel to the rotation pins (14), which mesh with one another.

8 Claims, 5 Drawing Sheets

(56) References Cited

U.S. PATENT DOCUMENTS

| | | | | | |
|---|---|---|---|---|---|
| 4,999,880 | A | | 3/1991 | Baer | |
| 5,001,810 | A | * | 3/1991 | Baer | 16/302 |
| 5,062,181 | A | * | 11/1991 | Bobrowski et al. | 16/354 |
| 5,201,902 | A | * | 4/1993 | Baer | 16/354 |
| 5,337,451 | A | * | 8/1994 | Goossens | 16/354 |
| 5,685,045 | A | * | 11/1997 | Lace | 16/354 |
| 5,966,777 | A | * | 10/1999 | Jantschek | 16/354 |
| 5,991,975 | A | * | 11/1999 | Baer | 16/354 |
| 6,073,310 | A | * | 6/2000 | Baer | 16/354 |
| 6,170,210 | B1 | * | 1/2001 | Marts | 52/232 |
| 2002/0035765 | A1 | * | 3/2002 | Baer | 16/354 |
| 2002/0138947 | A1 | | 10/2002 | Jantschek | |
| 2003/0177607 | A1 | * | 9/2003 | Pelletier | 16/354 |
| 2005/0091797 | A1 | * | 5/2005 | Dillingham | 16/354 |
| 2007/0094846 | A1 | * | 5/2007 | Ishida | 16/354 |
| 2009/0313790 | A1 | * | 12/2009 | Schau | 16/354 |

* cited by examiner

HINGE FOR FURNITURE

CROSS REFERENCE TO RELATED APPLICATION

This Application is a 371 of PCT/ES2013/070625 filed on Sep. 10, 2013, which, in turn, claimed the priority of Spanish Patent Application No. U201230970 filed on Sep. 19, 2012, both applications are incorporated herein by reference.

TECHNICAL FIELD

The present invention relates to a hinge for furniture, specially designed to act as a means for linking together two doors of the same piece of furniture, forming an angle with each other and which enables opening both doors in a combined manner.

The hinge of the invention is of the type that comprises a profile on which at least a pair of leaves are mounted by means of the corresponding rotation pins, and preferably two pairs of independent leaves, axially spaced from each other, each leaf being made up of a plate anchored to one of the doors, an end knuckle for mounting them onto the profile, and an intermediate arm connecting the knuckle and the leaf.

BACKGROUND OF THE INVENTION

From utility models number 1030929, 1063891 and 106578 hinges of the mentioned type are already known, in which the rotation pin of the hinges is embodied in a tubular supporting profile, wherein at each of the end portions thereof is mounted a pair of leaves. The appearance of the hinge assembly is determined by the combination of materials and colours thereof that form the leaves and the tubular profile, making it difficult for said assembly to be customized for each piece of furniture.

Moreover, the pairs of leaves are mounted onto the end portions of the supporting tubular profile, which may give rise to undesired interferences with the elements of the piece of furniture that they are linking. In addition, for a given length of the tubular profile, the spacing or distance between the pairs of leaves is fixed, which may impede the mounting of the hinge. With the aforementioned constitution it is also difficult to adapt the hinge to the different heights of doors or elements to be linked.

According to the mentioned background, the leaves of each pair of leaves are mounted onto the supporting profile by means of a common pin, which coincides with the axis of said profile.

DESCRIPTION OF THE INVENTION

The aim of the present invention is to eliminate the drawbacks set forth, by means of a hinge of the mentioned type, but constituted such that the supporting profile on which the leaves are mounted enables including a longitudinal ornamental cover, easily interchangeable, with which it is possible to customize the hinge for each furniture type, style or colour, and all that maintaining the general constitution of the assembly.

A further advantage of the hinge of the invention is that the pairs of leaves may be mounted in any area or spot along the supporting profile, spaced from the ends thereof, so that interferences with certain components of the piece of furniture are avoided, such as the covers thereof, which may hamper the correct operation of the hinge.

Another advantage of the hinge of the invention is that it enables linking two doors of a piece of furniture forming certain angle with each other, and which opening is carried out in a synchronised manner with the supporting profile.

As it has been previously indicated, the hinge of the invention is of the type that comprises a supporting profile on which at least a pair of leaves are mounted and preferably two pairs of independent leaves, each leaf being made up of a plate anchored to the door, an end knuckle for mounting them onto the supporting profile, and an intermediate arm connecting the knuckle and the leaf.

According to the invention both leaves of each pair of leaves are mounted in a transverse housing of the profile by means of as many independent and parallel rotation pins, which extend through the knuckles and are mounted onto the profile in a longitudinal direction.

According to a another feature of the invention, the knuckles of the two leaves of each pair of leaves have teeth parallel to the rotation axis of said knuckles, which teeth mesh one another in order to link the two leaves with respect to the supporting profile.

Preferably the hinge is made up of at least two pairs of leaves, which are mounted on as many housings of the profile, with the rotation pins of one pair of leaves and the other aligned along said profile.

With the recommended constitution, when for example two doors of a piece of furniture are linked by the hinge of the invention, preferably two doors forming a given angle with each other, the two doors will rotate about independent and parallel rotation pins, but in a synchronized manner with respect to the supporting profile, due to the mesh between the knuckles of the leaves belonging to the same single pair of leaves. Preferably the supporting profile of the hinge will bear elastic and internal means that will drive the two leaves towards a position in which the anchoring plates will form certain angle with each other, preferably an angle corresponding to the closed position of the two doors linked by the hinge. This way, once the doors are opened, the aforementioned elastic means will automatically drive the doors towards the closed position.

The supporting profile that makes part of the invention has a grooved section, preferably a C-shaped section, and is internally provided, from the core, with mortisings for mounting the rotation pins of the pairs of leaves.

The hinge of the invention may include two or more pairs of leaves, depending in any event on the dimensions, weight and features of the doors or elements to be linked. In any case the pairs of leaves will be spaced from each other and from the profile ends. For this purpose the housings in which the different pairs of leaves are mounted, shall be formed in the positions in which said pairs of leaves will be located.

The aforementioned elastic means that drive the doors towards their closed position may consist of a flat spring, like for example a plate with an elastically flexible character, which will be mounted through two of the opposed edges thereof in as many facing longitudinal grooves, with which the wings of the supporting profile are internally provided. This flat spring has a central window that determines two elastically flexible tongues resting against the knuckle of the two leaves of each pair of leaves. In addition, the knuckles will have on their external surface arrangements defining support abutments for the elastically flexible tongues of the flat spring, said abutments being positioned such that the tongues occupy a resting position when the doors are located in their closed position, whereas when they move to any opened position, they deform transversally the elastic tongues whereby actuating against the abutments of the knuckles of the leaves, driving them towards the closed position.

Preferably each pair of leaves will be mounted in a U-shaped intermediate support, for example made of plastic material, which will be coupled in the transverse housing of the supporting profile, fitted to the edge of said housing. Between the wings of this intermediate support the knuckles of the pair of leaves will be located, such that the corresponding rotation pins extend through the wings of the support and knuckles of the two leaves.

The longitudinal opening of the supporting profile remains closed by means of an external ornamental plate. For this purpose, said profile is internally provided, from the free edge of the wings thereof, with longitudinal projections or ribs, which determine along said wings internal seats for the external ornamental plate and for an internal laminar spring that presses said external ornamental plate against the seats thereof, thus guaranteeing its positioning in the profile.

BRIEF DESCRIPTION OF THE DRAWINGS

In the appended drawings a possible embodiment of the hinge of the invention is shown, provided by way of non-limiting example. In the drawings.

DETAILED DESCRIPTION OF AN EMBODIMENT

Figure 1:
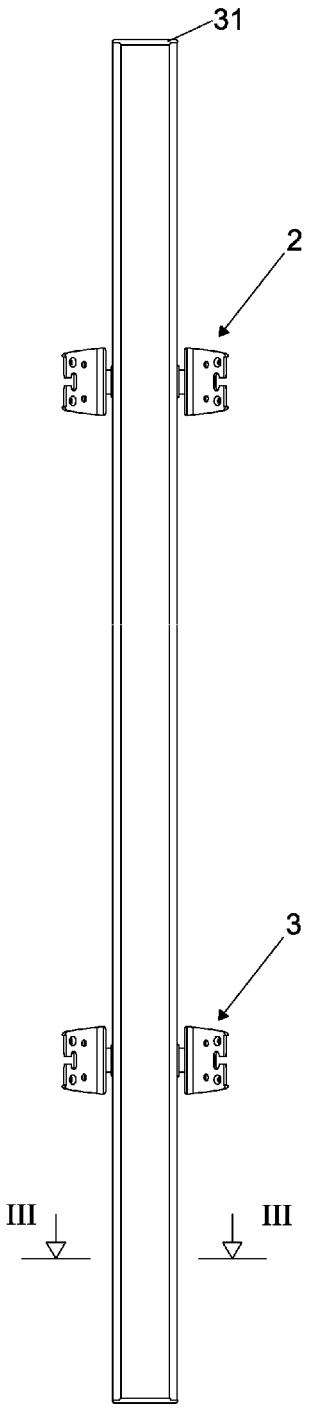
FIG. 1 is a frontal elevation view of a hinge constituted in accordance with the invention.
Figure 2:
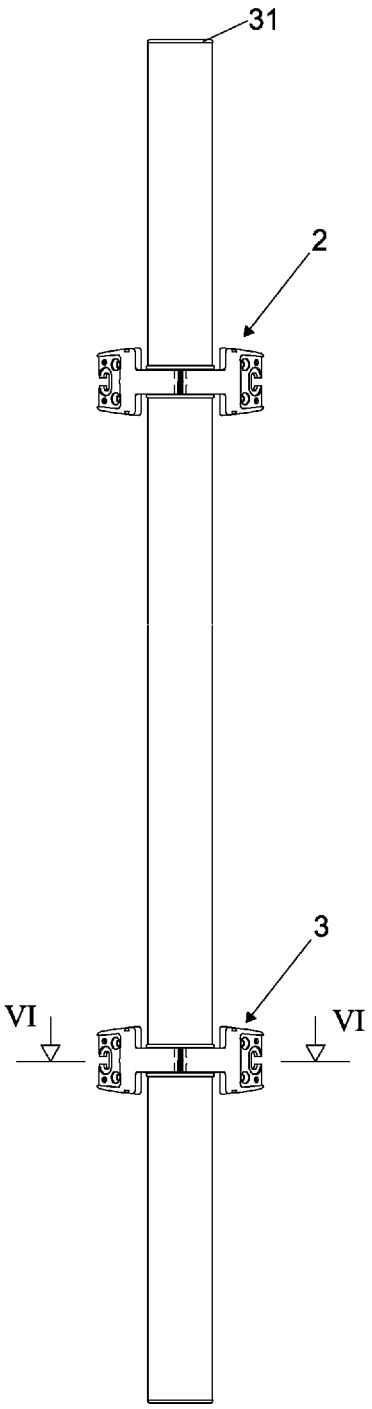
FIG. 2 is a rear elevation view of the same hinge.
Figure 3:
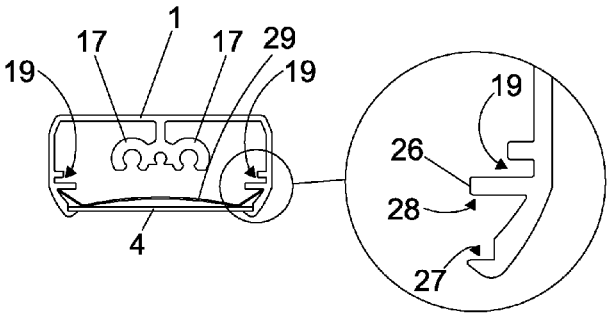
FIG. 3 is a cross-sectional view of the hinge, taken along the cutting line III-III of FIG. 1.

As shown in FIGS. 1 to 3, the hinge is made up of a supporting profile 1, in which two pairs of leaves having the same features and constitution are mounted, referenced with numerals 2 and 3, these two pairs of leaves occupying in the profile positions that are axially spaced from one another and from the ends of said profile.

As it can be appreciated in FIG. 3, the profile 1 has a C-shaped section, remaining the longitudinal opening thereof closed by means of an ornamental plate 4.

Figure 4:
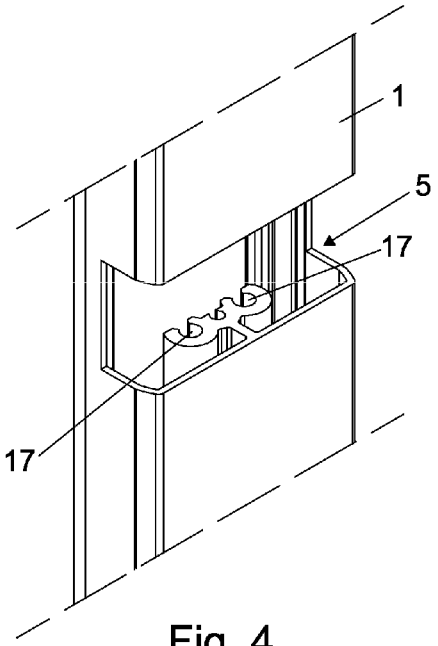
FIG. 4 shows a perspective view of one of the housings of the supporting profile of the hinge, in which a pair of leaves are mounted.

Each pair of leaves is mounted in a transverse housing 5, FIG. 4, obtained in the profile 1 through the opening carried out therein from the central core.

Figure 5:
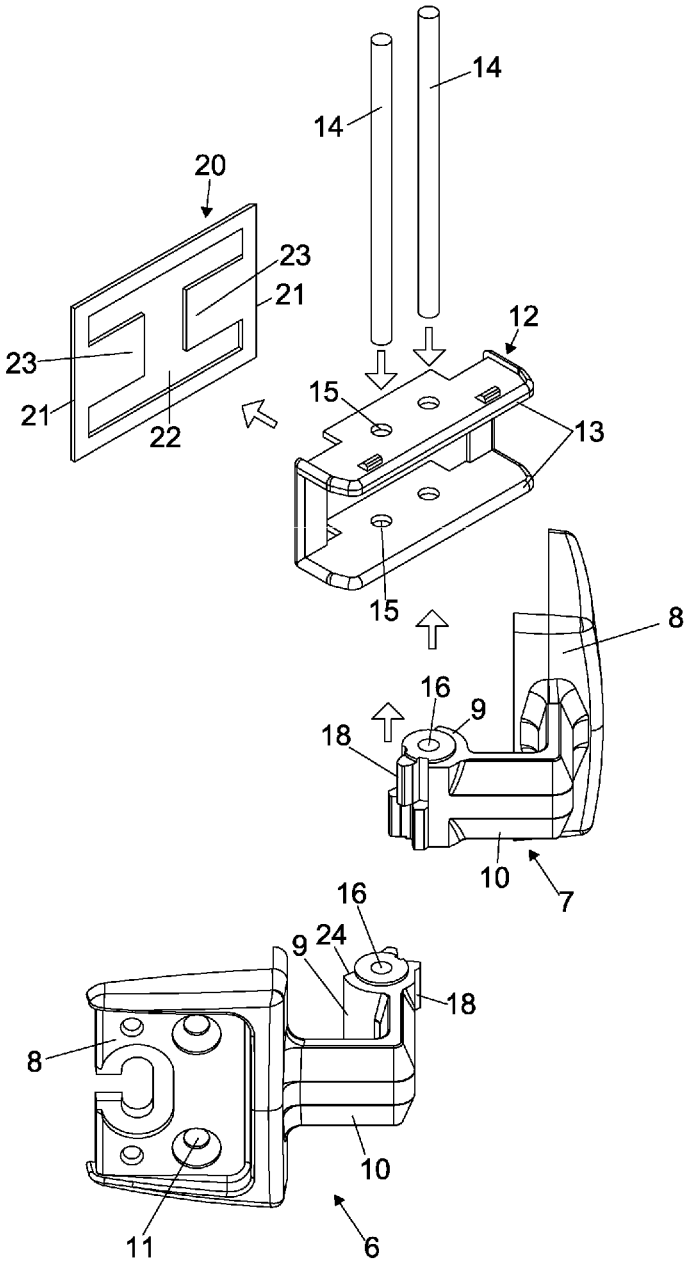
FIG. 5 is an exploded perspective view of the components assembly forming the pair of leaves, which is mounted in each housing of the profile of FIG. 4.

As it can be appreciated in FIG. 5, each pair of leaves is made up of two equal leaves 6 and 7, comprising each one of them a plate 8 for their anchoring to a door, an end knuckle 9 to be mounted on the ornamental profile 1, and an intermediate arm 10 linking the end plate 8 and the knuckle 9. As it can be appreciated in FIG. 6, the intermediate arm 10 has an elbow shape, at a right angle. The plates 8 are provided with holes 11 through which screws pass for fastening them to the door.

The two leaves 6 and 7 of each pair of leaves are mounted in the housing 5 of the profile 1 by means of an U-shaped support 12, FIG. 5, between the wings 13 thereof, the end knuckles 9 of the two leaves are mounted, by means of bars or rods 14 that extend through the wings 13 and end knuckles 9 through facing holes 15 of said wings and bores 16 of the knuckles aligned with said holes.

The rods 14 protrude externally from the support 12 wings 13 in portions that are mounted in mortisings 17, FIG. 4, formed within the profile 1, from the core thereof With this constitution, the two leaves 6 and 7 of each pair of leaves are mounted on the profile 1 along two parallel and independent axis defined by the rods 14, which run in a direction parallel to the profile 1 axis.

Figure 6:
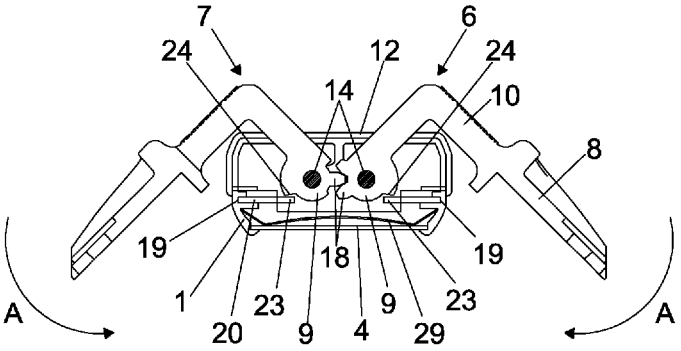
FIG. 6 is a cross-sectional view of the hinge, taken along the cutting line VI-VI of FIG. 2.

As it can be further appreciated in FIG. 5, the knuckles 9 of the leaves 6 and 7 are externally provided with teeth 18 parallel to the rotation pins of the leaves, defined by the rods 14, the teeth of which mesh one another to link the two leaves 6 and 7 of each pair of leaves and the profile 1, all that as it can be better appreciated in FIG. 6, With this constitution a synchronised rotation between the two leaves 6 and 7 and the profile 1 is achieved, in such a way that said leaves may describe the same angle in one direction or the other relative to the profile.

As it can be appreciated in FIG. 6, the wings of the profile 1 are internally provided with longitudinal facing grooves 19, among which a flat spring 20 is mounted, which, as shown in FIG. 5, is constituted by a plate, with a steeling character, for instance, which is mounted through its edges 21 in the grooves 19 and has a central opening 22 that determines two facing tongues 23, each one of them rests on abutments 24, FIG. 6, formed in the knuckles 9.

The abutments 24 are positioned such that when the leaves 6 and 7 occupy the position of FIG. 6, that may correspond to the closed position of the doors linked by said leaves, the tongues 23 are at rest, without deformation whatsoever, whereas upon rotating the leaves in the direction of the arrows A of FIG. 6, the elastic deformation of the tongues 23 takes place, action which will drive the leaves 6 and 7 so as to return to the position of FIG. 6.

Figure 7:
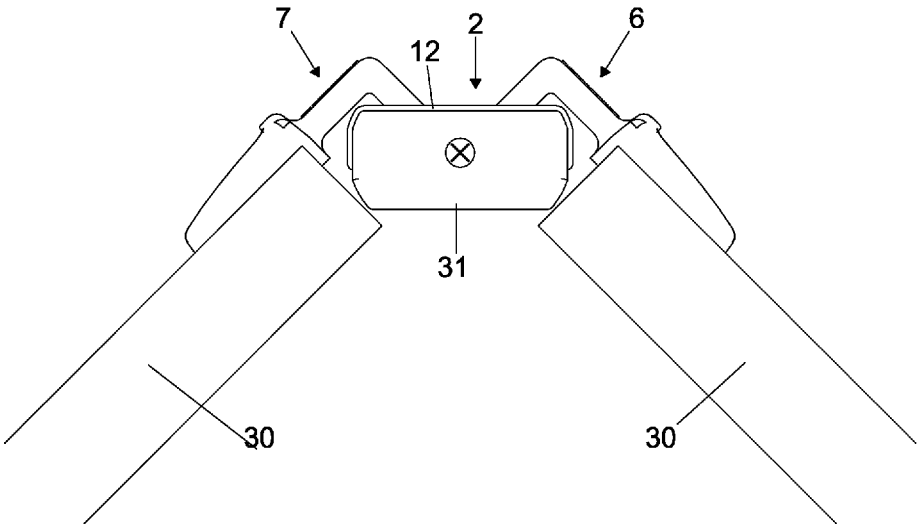
FIGS. 7, 8 and 9 show a plant view of different angles that two doors linked by means of the hinge of the invention may form with each other.
Figure 8:
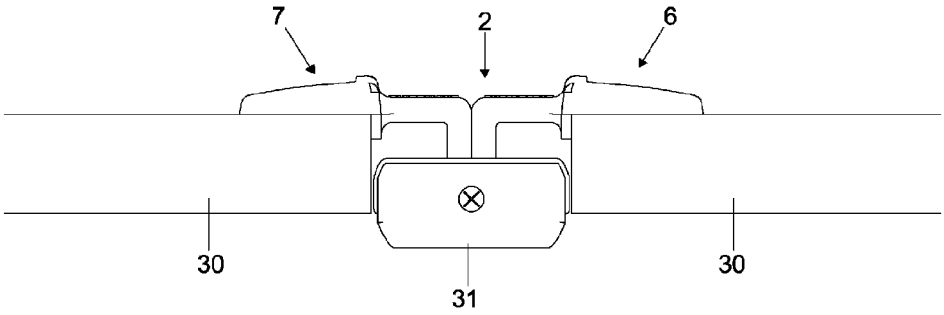
Figure 9:
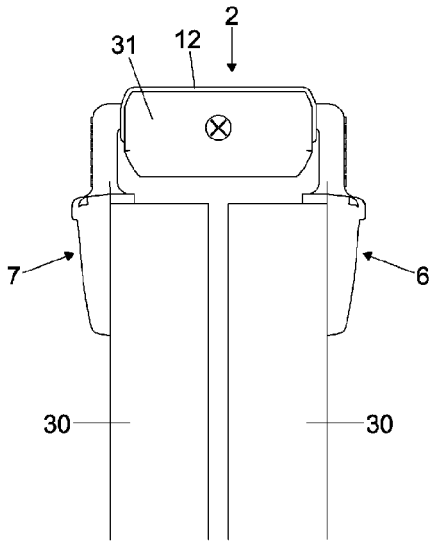

As it can be observed in FIG. 3, the wings of the profile 1 are further provided internally, from their free edge, with ribs 25-26 that determine longitudinal seats 27-28 between which the ornamental plate 4 and an internal, longitudinal and laminar spring 29, which guarantees the positioning of the plate 4, are mounted. In FIG. 7 a plant view of a hinge 2 linking two doors 30 is shown, with the leaves 6 and 7 at the same angle that in FIG. 6. In FIG. 8 the same hinge is shown, with the leaves 6 and 7 and the corresponding doors 30 arranged in a coplanar position, whereas in FIG. 9 the leaves 6 and 7 are in a parallel position, with the doors 30 forming an angle of 0 degrees.

As it can be appreciated in FIGS. 1, 2 and 7 to 9, the profile 1 is closed at the ends thereof by means of covers 31.

The invention claimed is:

1. A hinge for furniture comprising: at least a pair of leaves mounted on a supporting profile, each leaf including an anchoring plate for anchoring the leaf to a piece of furniture, an end knuckle for mounting thereof on the profile, and a connecting intermediate arm between the end knuckle and the anchoring plate; wherein the leaves are mounted in a transverse housing of the profile by respective parallel independent rotation pins, which extend through the knuckles and are mounted on the profile in a longitudinal direction; the knuckles of the leaves each have teeth parallel to the rotation pins, which mesh with one another; and the supporting profile bears internal elastic means, which drive both leaves towards a position, in which the anchoring plates form a certain angle with each other.

2. The hinge according to claim 1, wherein the at least a pair of leaves comprises at least two pairs of leaves, which are mounted on respective housings of the profile, with the rotation pins of one pair of leaves and the other aligned along the profile.

3. The hinge according to claim 2, wherein the housings in which the different pairs of leaves are mounted, are located in positions axially spaced from each other and from the ends of the profile.

4. The hinge according to claim 1, wherein the supporting profile includes wings with respective longitudinal facing grooves, and the elastic means comprise a flat spring with opposed edges, the flat spring being mounted, through the opposed edges thereof, in the respective longitudinal facing grooves of the wings of the supporting profile, the flat spring of which has a central window that determines two elastically flexible tongues, which rest against the knuckle of the two leaves of each pair of leaves, coinciding with respective abutments of said knuckles.

5. The hinge according to claim 1, wherein the piece of furniture is a door, such that the at least a pair of leaves are anchored to two doors of the furniture, and the certain angle is an angle corresponding to the closed position of the two doors.

6. A hinge for furniture comprising: at least a pair of leaves mounted on a supporting profile, each leaf including an anchoring plate for anchoring the leaf to a piece of furniture, an end knuckle for mounting thereof on the profile, and a connecting intermediate arm between the end knuckle and the anchoring plate; wherein the leaves are mounted in a transverse housing of the profile by respective parallel independent rotation pins, which extend through the knuckles and are mounted on the profile in a longitudinal direction, the knuckles of the leaves each have teeth parallel to the rotation pins, which mesh with one another, and the supporting profile has a C-section and is provided internally, from a core, with mortisings for mounting the rotation pins of the pairs of leaves.

7. The hinge according to claim 6, wherein the supporting profile is provided internally, from a free edge of wings thereof, with projections or longitudinal ribs which determine along said wings, seats for an external ornamental plate and an internal, longitudinal and laminar spring that presses said external ornamental plate against the seats thereof.

8. A hinge for furniture comprising: at least a pair of leaves mounted on a supporting profile, each leaf including an anchoring plate for anchoring the leaf to a piece of furniture, an end knuckle for mounting thereof on the profile, and a connecting intermediate arm between the end knuckle and the anchoring plate; wherein the leaves are mounted in a transverse housing of the profile by respective parallel independent rotation pins, which extend through the knuckles and are mounted on the profile in a longitudinal direction, the knuckles of the leaves each have teeth parallel to the rotation pins, which mesh with one another, and each pair of leaves is mounted on an U-shaped intermediate support that is coupled into the transverse housing of the supporting profile and between wings of the U-shaped intermediate support are located the knuckles of the pair of leaves, such that the rotation pins extend through the wings of the U-shaped intermediate support and the knuckles.

* * * * *